US011414816B2

(12) United States Patent
Anzel et al.

(10) Patent No.: US 11,414,816 B2
(45) Date of Patent: Aug. 16, 2022

(54) METHOD AND DEVICE FOR TREATING A FIBROUS MATERIAL WEB IN A LONG NIP PRESSING UNIT

(71) Applicant: ANDRITZ AG, Graz (AT)

(72) Inventors: Andreas Anzel, Graz (AT); Robert Meitner, Krefeld (DE); Paul Richards, Gössendorf (AT); Wolfgang Plienegger, Graz (AT)

(73) Assignee: ANDRITZ AG, Graz (AT)

( * ) Notice: Subject to any disclaimer, the term of this patent is extended or adjusted under 35 U.S.C. 154(b) by 0 days.

(21) Appl. No.: 16/971,766

(22) PCT Filed: Feb. 19, 2019

(86) PCT No.: PCT/EP2019/054041
§ 371 (c)(1),
(2) Date: Aug. 21, 2020

(87) PCT Pub. No.: WO2019/166271
PCT Pub. Date: Sep. 6, 2019

(65) Prior Publication Data

US 2021/0087746 A1 Mar. 25, 2021

(30) Foreign Application Priority Data

Mar. 1, 2018 (AT) ..... A 50177/2018

(51) Int. Cl.
*D21F 3/02* (2006.01)
*D21F 3/04* (2006.01)
(Continued)

(52) U.S. Cl.
CPC ..... *D21F 3/0227* (2013.01); *D21F 3/045* (2013.01); *D21F 7/12* (2013.01); *D21F 11/14* (2013.01); *D21H 27/002* (2013.01); *F26B 13/24* (2013.01)

(58) Field of Classification Search
CPC ..... D21F 3/0227; D21F 3/045; D21F 7/12; D21F 11/14; D21F 3/0218; D21F 11/006;
(Continued)

(56) References Cited

U.S. PATENT DOCUMENTS 5,741,402 A * 4/1998 Trokhan ..... D21F 1/52 162/306
6,004,429 A 12/1999 Schiel
(Continued)

FOREIGN PATENT DOCUMENTS

DE 10233920 A1 2/2004
EP 1075567 B1 8/2003

OTHER PUBLICATIONS

International Search Report dated Apr. 9, 2019 (PCT/EP2019/054041).

*Primary Examiner* — Eric Hug
*Assistant Examiner* — Matthew M Eslami
(74) *Attorney, Agent, or Firm* — Alix, Yale & Ristas, LLP

(57) ABSTRACT

A method for treating a pulp web in a paper or tissue machine with an extended-nip press unit. This extended-nip press unit includes a shoe press roll with a revolving press belt and a backing roll, where the pulp web is dewatered in the extended press nip between the backing roll and the press belt and where the pulp web is carried on the revolving press belt of the press roll after the extended press nip to a transfer fabric that receives the pulp web. The transfer fabric is guided over a stationary transfer device in the transfer area. A corresponding device for treating the pulp web.

20 Claims, 6 Drawing Sheets

(51) Int. Cl.

| | |
|---|---|
| ***D21F 7/12*** | (2006.01) |
| ***D21F 11/14*** | (2006.01) |
| ***D21H 27/00*** | (2006.01) |
| ***F26B 13/24*** | (2006.01) |

(58) Field of Classification Search
CPC ... D21F 2/00; D21F 1/52; D21F 11/00; D21F 3/02; D21F 3/04; D21H 27/002; F26B 13/24
See application file for complete search history.

(56) References Cited

U.S. PATENT DOCUMENTS

| | | | | |
|---|---|---|---|---|
| 6,197,159 | B1 | 3/2001 | Meinecke et al. | |
| 8,083,897 | B2 | 12/2011 | Scherb et al. | |
| 8,871,060 | B2 * | 10/2014 | Klerelid | D21F 11/006 162/217 |
| 10,633,794 | B2 | 4/2020 | Tolfsson et al. | |
| 2001/0004007 | A1 * | 6/2001 | Puustinen | C04B 26/10 162/286 |
| 2012/0055644 | A1 | 3/2012 | Mausser et al. | |

* cited by examiner

METHOD AND DEVICE FOR TREATING A FIBROUS MATERIAL WEB IN A LONG NIP PRESSING UNIT

BACKGROUND

The disclosed embodiments relate to a method for treating a pulp web in a paper or tissue machine with an extended-nip press unit. This extended-nip press unit consists of a shoe press roll with a revolving press belt and a backing roll, where the pulp web is dewatered in the extended press nip between the backing roll and the press belt and where the pulp web is carried on the revolving press belt of the press roll after the extended press nip to a transfer fabric that receives the pulp web. The inventive embodiments also relate to a press arrangement with which the method according to the invention is conducted.

In conventional processes for the production of paper and tissue, a pulp web is dewatered mechanically before thermal drying by being pressed directly onto a Yankee dryer. A production method of this kind is described in DE 102 33 920 A1. However, mechanical pressing and the line pressure that can be achieved is limited in these paper and tissue machines because the web is pressed against the Yankee dryer. By including an upstream pressing stage, as described in EP 1 075 567 B1 for example, mechanical dewatering takes place in a press unit that is independent of the Yankee dryer. It is possible to set optimum pressing conditions here because the web is no longer pressed against the dryer so pressing is not restricted by the dryer's load limits. Mechanical dewatering can be improved substantially with this upstream pressing stage performed with an extended-nip press unit, especially a shoe press. The effort required for thermal drying is reduced, and this results in energy savings. Concerning the web run, the pulp web in EP 1 075 567 B1, for example, is transferred in the press nip of the upstream pressing stage to an impermeable belt that also runs through the press nip and is then carried on this belt to a subsequent Yankee cylinder. WO 2016/186 562 A1 discloses a method with the following web run: Transfer of the pulp web to a belt in the press nip of the upstream pressing stage, guiding of the pulp web and the belt to a structured, permeable fabric, transfer of the pulp web from the belt to the structured, permeable fabric in a transfer nip that is 5-40 mm long in machine direction between a first transfer roll and a second transfer roll (suction roll), guiding of the pulp web from the structured, permeable fabric to a dryer.

Conversely, it is known from EP 0 854 229 B1 that initial dewatering takes place between the top felt and a bottom felt in the upstream press after the pulp web has formed on a top felt and the pulp is finally transferred from the top felt to a dryer in a main press formed by a top roll and a dryer.

The methods described in EP 1 075 567 B1 and in EP 0 854 229 B1 each disclose a closed web run for the pulp web between sheet formation and Yankee dryer. Conversely, the pulp web in EP 1 314 817 B1 is dewatered in an upstream press nip, where the web from the smooth roll is guided unsupported in an open draw from the smooth roll to an embossing belt.

For dewatering in an extended-nip press unit, for example a shoe press, the pulp web is carried on a felt through an extended press nip formed by a shoe press roll with a revolving press belt and by a backing roll. After the extended press nip, the felt is separated as quickly as possible from the pulp web. The pulp web is then either carried onwards on a fabric that is also guided through the extended press nip, on the belt of the shoe press roll in the extended-nip press unit, or on the backing roll.

For example, AT 508 331 B1 discloses a method in which the pulp web is dewatered in an extended press nip formed by a shoe press roll and a backing roll and guided on the revolving press belt of the shoe press roll from the extended press nip to a transfer area in which the pulp web is transferred from the press belt to a roll or a transfer fabric. Here, the transfer fabric is wrapped around the press belt and the transfer is assisted by a suction roll.

The options disclosed for removing the pulp web from a fabric guided through the press nip or from a roll have included (1) unsupported removal via another roll or (2) supported removal with the aid of another fabric and a roll to which suction is applied.

Unsupported (open) transfer of a pulp web with a low basis weight, i.e. an oven-dry basis weight of less than 50 g/m$^2$ in the extended-nip press unit, usually less than 35 g/m$^2$ and generally less than 25 g/m$^2$, is very problematic and very susceptible to breaks and production downtime because of the pulp web's low wet strength. Hence, supported (closed) transfer suggests itself for a pulp web with a low basis weight. Supported, closed transfers are executed according to the state of the art as a press nip between two rolls—to one of which suction can also be applied. Here, forces of 4 to 15 kN/m—preferably 4 kN/m to 8 kN/m—are typically transferred in the transfer nip. The nip length between two rolls is greater than or equal to 5-40 mm according to the state of the art (WO 2016/186 562 A1). Thus, in the state of the art, relevant forces in the transfer nip (press nip) are transferred over relevant working lengths. In order to further improve transfer of the pulp web and also further minimize the risk of damage to the web, ways are sought to carry out the transfer in a clearly defined area, which is especially important at high relative speeds in the transfer area.

SUMMARY

Disclosed herein is a method for supported, closed transfer of a pulp web in an extended-nip press unit, where the pulp web is transferred from a press belt in a clearly defined area to another fabric, making optimum transfer of the pulp web possible without damaging it. In addition, the design of a press and transfer arrangement for a paper or tissue machine with a compact structure is to be disclosed.

In the disclosed method, the pulp web is guided to a transfer area on the revolving press belt of the press roll after the extended press nip. Hence, the revolving press belt not only performs its function as a pressing element, but serves at the same time as a means of onward transport for the pulp web after mechanical dewatering. The pulp web adheres to the flexible press belt after pressing. In the transfer area, the pulp web is passed on from the press belt to a transfer fabric. This is performed with the aid of a stationary transfer device. Within the context of the inventive embodiments disclosed herein, a stationary transfer device is understood as being a non-revolving transfer device.

Thus, the transfer fabric receives the pulp web in the transfer area, where the rear side of the transfer fabric runs over a stationary transfer device here and is supported by it.

Contrary to the state of the art, where the transfer to the transfer fabric is assisted by a rotating suction roll, a very short and precisely defined transfer area can be achieved with the stationary transfer device. So far in the state of the art, it was assumed that the transfer area must be as long as possible for reliable transfer of the pulp web to the transfer fabric in the transfer area. However, the inventors have noted that precisely the shortest transfer area possible can yield considerable advantages. The inventors have also noted that the transfer area must be exactly defined in order to achieve reliable transfer. This is hardly possible with rotating rolls.

Hence, reliable web transfer is ensured by passing the web on in a clearly defined area. An extended transfer area, for example by the transfer fabric being wrapped round the press belt beforehand or afterwards, should be avoided. Similarly, the area in which the pulp web is transferred—i.e. the distance over which the press belt and the transfer fabric are in contact with one another—should be clearly defined.

The transfer fabric can be permeable machine clothings, which can be structured or otherwise, e.g. the wires commonly used in paper production, preferably structured dryer fabrics as are normally used in TAD (through-air drying) applications.

In a preferred embodiment, suction is applied to the transfer device. The stationary transfer device can be designed as a slotted suction device, for example. Ideally, the contact surface of such transfer devices is made of a low-wear and low-friction material, for example ceramic. The contact surface of the stationary transfer device guides the transfer fabric to the transfer zone (transfer area), where there is preferably no lubrication, as this would lead to wetting of the transfer fabric directly upstream of the transfer zone.

Permeable transfer fabrics have the advantage that the pulp web transfer from the press belt to the transfer fabric is assisted by suction being applied to the stationary transfer device and thus due to the pulp web being held on by suction through the transfer fabric.

As the press belt of the shoe press roll does not form a rigid surface like the surface of a roll, for example, it is advantageous to apply measures to stabilize the revolving press belt. Hence, it is advantageous to place the press belt of the shoe press roll under positive pneumatic pressure, where the positive pneumatic pressure is normally less than 250 mbar, typically <100 mbar. Even running of the press belt can be ensured with this stabilisation measure. This has a positive effect on the service life of the press belt and on its true-running properties.

The pulp web is preferably guided through the extended press nip on a felt. In this case, the felt absorbs the moisture from the pulp web in the extended press nip. In order to avoid re-wetting of the pulp web, it is useful to separate the felt from the pulp web immediately after the extended press nip.

In a preferred embodiment, the press belt is supported by supporting elements on the inner side of the press belt before and after the transfer area. This provides additional stability for the press belt in the transfer area. Bars can be used, for example, as supporting elements. The contact surface of a supporting element in contact with the inner side of the press belt is typically curved in the same way as the belt surface or a correspondingly smaller curve. Hydrostatic and/or hydrodynamic lubrication of the supporting element contact surface is advantageous to reduce friction between the press belt and the supporting element.

In a preferred embodiment, the supporting elements push outwards in radial direction by between 0 and 20 mm out of the press belt of the press roll. As a result of the supporting elements pushing outwards in radial direction against the shoe roll press belt, improved stabilization of the revolving press belt is achieved in the area of the transfer zone, which enables improved transfer of the pulp web from the press belt to the transfer fabric. Radial outward push of 0 mm here means that the supporting elements only just touch the press belt under air pressure and that there is no open gap between the supporting element and the press belt. Radial outward push of 20 mm, beginning at only just touching the press belt (0 mm position), means in this sense that the supporting element is moved outwards radially by 20 mm, where the center point of the shoe roll forms the point of reference.

In a preferred embodiment, the angle $\alpha$, viewed from the press roll axis, between the supporting element in front of the transfer area and the transfer area itself is less than 15° and the angle $\beta$ between the supporting element after the transfer area and the transfer area itself is less than 30°. The imaginary contact line between supporting element and press belt or, alternatively, the line of symmetry of the supporting elements is used to determine the angle for the supporting elements. The imaginary contact line between the stationary transfer device and the press belt is used to determine the angle for the transfer area. The press belt is not supported in the area between the supporting elements.

In a preferred embodiment, the stationary transfer device and the transfer fabric running over it are inserted radially by 0 to 20 mm into the press belt of the press roll in the transfer area. Radial insertion of 0 mm here means that the stationary transfer device and the transfer fabric running over it touch the press belt under air pressure and that there is no open gap between the transfer fabric and the press belt. Radial insertion of 20 mm inwards, beginning at only just touching the press belt (0 mm position), means in this sense that the transfer device is moved inwards radially by 20 mm, where the center point of the shoe roll (axis of rotation) forms the point of reference.

In a preferred embodiment, the transfer device is inserted freely into the press belt of the shoe roll under pneumatic pressure, which means that there is no mechanical support provided, such as a limit stop, shoe, counter-pressure element, etc., in the transfer area on the side of the press belt opposite the transfer device. As a result, the forces prevailing can be kept significantly lower in the transfer area than they are in the state of the art.

In a preferred embodiment, the radial depth of insertion by the stationary transfer device into the press belt of the press roll is set by a device outside the press roll. For example, the stationary transfer device can be secured to a pivoting lever arm on the frame, where it is possible to insert it radially into the press belt of the shoe roll in accordance with the center of rotation of the lever arm—taking the center point of the shoe roll as reference.

In another preferred embodiment, the pulp web is transferred from the press belt of the shoe roll to the transfer fabric within a transfer area of less than 10 mm, preferably within less than 5 mm and ideally along one line. The contact length between press belt and transfer fabric is hence very short compared to the state of the art. The length of the transfer area can be assessed by taking an impression with a pressure-sensitive film, e.g. with a Fujifilm (Ultra Extreme Low Pressure 5 L W). To do so, the pressure-sensitive film is inserted into the transfer area with the press and transfer arrangement at a standstill. Then the stationary transfer device with transfer fabric is brought into the operating position against the press belt under pneumatic pressure. Depending on the contact between the components—stationary transfer device, transfer fabric, Fujifilm and press belt—the pressure-sensitive film changes color. A change of color indicates contact and the color change indicates the transfer area. The forces acting in the transfer area are typically <4 kN/m, preferably <2 kN/m, and ideally <1 kN/m.

In a preferred embodiment, the transfer fabric runs onto the stationary transfer device before the pulp web is received on the press belt of the press roll and is carried through the device. This ensures that the transfer fabric is not wrapped round the press belt of the shoe roll before the transfer area. This arrangement further ensures that the transfer fabric does not come into contact with the pulp web until it reaches the transfer area.

In a preferred embodiment, the stationary transfer device is designed as a slotted suction device, where suction is applied to the transfer fabric through the slot between a first and second suction slot edge, and where the slotted suction device has a curved area before the first suction slot edge on the inlet side and the effective length of the curve in the curved area up to the first suction slot edge is smaller than 30 mm, for example, and preferably smaller than 15 mm. Contact between the stationary transfer device and the transfer fabric, the pulp web and the press belt takes place in the curved area, in particular in front of the first suction slot edge on the inlet side, where the transfer area is also in the curved section in front of the first suction slot edge on the inlet side. This embodiment allows clear definition of the transfer area in particular, where the transfer area is shorter than 10 mm, preferably shorter than 5 mm, and is ideally a line.

In a preferred embodiment, the transfer fabric does not touch the press belt until it reaches the transfer area, where the transfer fabric is not wrapped round the press belt beforehand or afterwards. In this sense, the angle $\gamma$ between the transfer fabric carried into the transfer area over the stationary transfer device and the tangent to the press belt in the transfer area is greater than zero degrees, meaning that there is no contact between the transfer fabric, pulp web and press belt until the transfer area. Similarly, the angle $\delta$ between the transfer fabric carried out of the transfer area and the tangent to the press belt is greater than zero degrees in the transfer area, with the result that the transfer fabric is not wrapped round the press belt after the transfer area and there is only contact between the transfer fabric, pulp web and press belt in the transfer area.

If the pulp web is transferred from the press belt to the transfer fabric with a speed difference between the press belt and the transfer fabric, another pulp web treatment step can be performed at the same time. In a preferred embodiment, the transfer fabric moves at a lower relative speed than the press belt in the transfer area and the pulp web is creped when it is transferred from the press belt to the transfer fabric.

In a preferred embodiment, the pulp web is carried over a (further) suction device together with the transfer fabric after being transferred from the press belt of the press roll to the transfer fabric for further securing of the pulp web on the transfer fabric. This suction device can be designed as a suction box, for example, or as a moulding box. The structure of the transfer fabric is then embossed on the pulp web in this securing step.

Conditioning of the transfer fabric is of particular importance. The transfer fabric receives the pulp web in the transfer area and then transfers the pulp web to a dryer, e.g. a Yankee dryer, or it is guided through a TAD (through-air drying) drum.

When the pulp web has been passed on to the subsequent unit, the transfer fabric should be conditioned. Flooded nip showers or high-pressure nozzles are used traditionally for this purpose. Vacuum boxes or air knives (pressurized air blades) can be used for subsequent dewatering of the transfer fabric. It is feasible to feed a hot fluid, such as hot air, hot exhaust air from a drying unit, steam, etc. through the transfer fabric for the purposes of further dewatering. In order to avoid renewed wetting of the transfer fabric after dewatering and before the transfer area, lubrication of the doctors on the guide rolls to guide the transfer fabric can be omitted.

Application of a boundary surface control compound, e.g. a release chemical, to the surface of the transfer fabric before it passes through the transfer area can have a positive effect on the process. For example, it can be applied using a spray bar that sprays the boundary surface control compound onto the transfer fabric. With this process step, the extent to which the pulp web adheres to the transfer fabric can be controlled effectively.

BRIEF DESCRIPTION OF THE DRAWINGS

In the following, the invention is described on the basis of drawings. In these drawings.

DETAILED DESCRIPTION

Identical reference figures in the individual figures refer to the same components.

Figure 1:
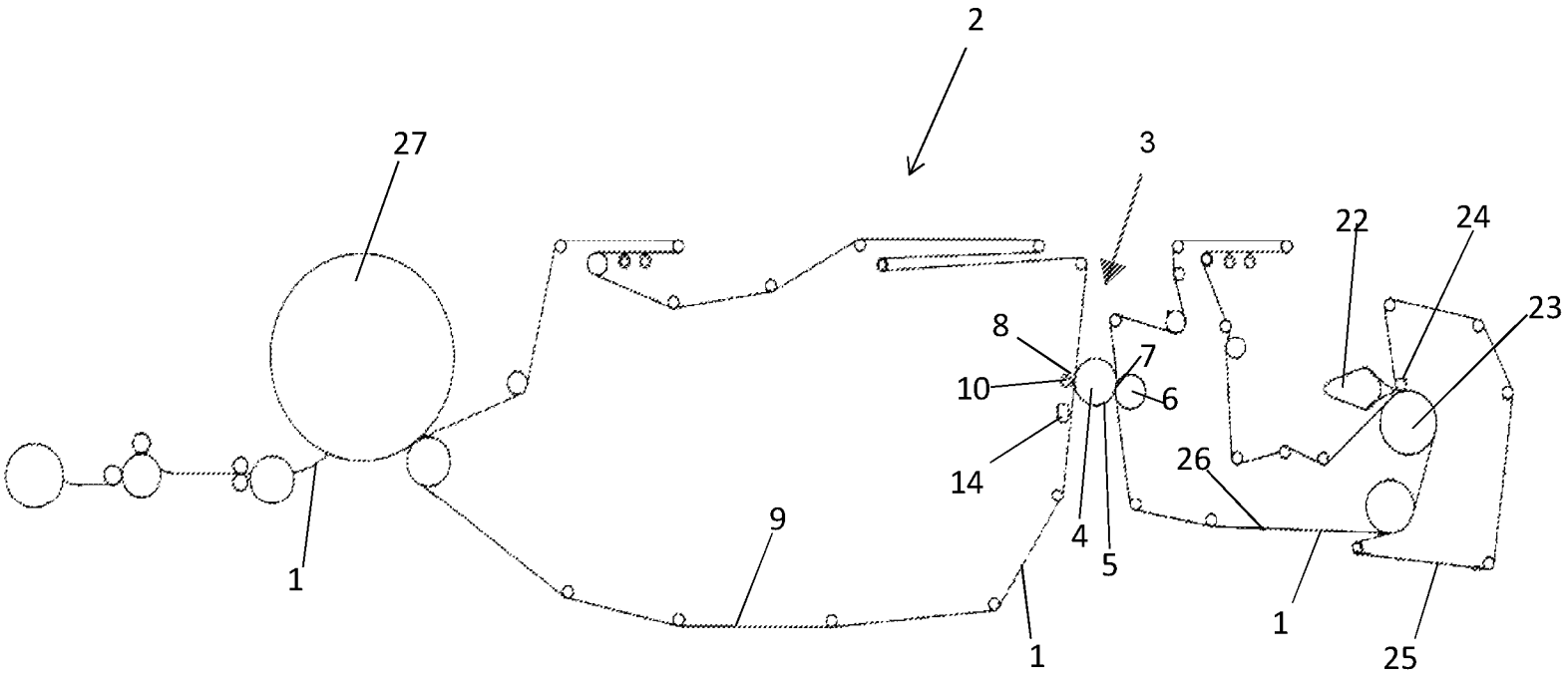
FIG. 1 shows a tissue machine with the disclosed press and transfer arrangement.

FIG. 1 illustrates a tissue machine 2 with the press arrangement according to the disclosure.

The pulp suspension is fed to the forming unit through a headbox 22 and leaves the headbox 22 between a breast roll 24 and a forming roll 23. Another fabric 25 is wrapped round the breast roll 24. In the forming unit, the pulp suspension is dewatered so that a material web 1 forms on the clothing 26. The clothing 26 is preferably a felt that conveys the pulp web 1 to a shoe press roll (press roll) 4.

The press arrangement according includes an extended-nip press unit 3, which contains a press roll 4 with a revolving press belt 5 and a backing roll 6. An extended press nip 7 is formed between the press roll 4 and the backing roll 6.

The disclosed press arrangement operates as follows:

The pulp web 1 is carried through the extended press nip 7 on the felt 26. The felt 26 absorbs moisture from the pulp web 1 in the extended press nip 7. Immediately after the extended press nip 7, the felt 26 is separated from the pulp web 1 so that re-wetting of the pulp web is avoided.

Figure 8:
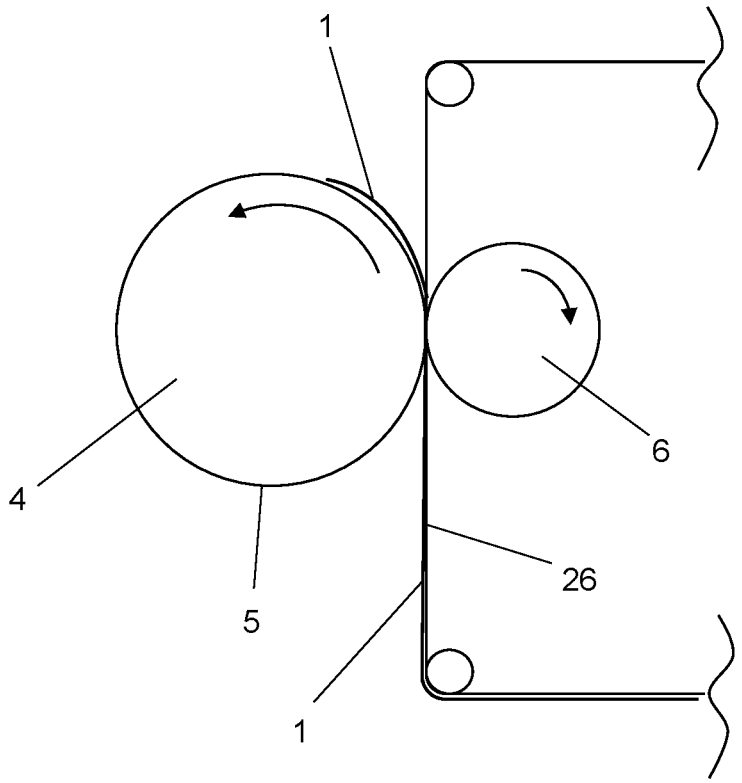
FIG. 8 shows an enlarged view of the press roll and the backing roll, and web being transferred from the clothing to the press belt of the press roll.

As shown most clearly in FIG. 8, after the extended press nip 7, the pulp web 1 no longer runs on the felt 26, but on the press belt 5 of the press roll 4. The press belt 5 transfers the pulp web 1 to a transfer fabric 9 in a transfer area 8. Transfer of the pulp web to the transfer fabric 9 is assisted by the transfer device 10, to which suction is applied. The transfer fabric 9 in the present example is structured and permeable.

In the present example, another web treatment step is applied to the pulp web 1 in the transfer area 8, namely creping. For this purpose, the surface of the transfer fabric 9 moves through the transfer area 8 a little slower (lower relative speed) than the press belt 5, causing the pulp web 1 to be compressed slightly and creped when it is transferred to the transfer fabric 9.

Mechanical dewatering in the extended-nip press unit 3 is followed by thermal drying on a Yankee dryer 27, from which the dry pulp web 1 is scraped off with the aid of a doctor, for example.

Conditioning of the transfer fabric 9 should be conducted in such a way that there is no or only very little wetting of the transfer fabric 9 by the conditioning process. Thus, conditioning can be performed with compressed air, for example, or a pressurized air blade. If water is used for conditioning, it must be guaranteed that the transfer fabric 9 is dried or dried by suction before the pulp web 1 is placed on it again.

In order to secure the pulp web 1 to the transfer fabric 9, it is also advantageous if the pulp web 1 is secured to the transfer fabric 9 after the pulp web 1 is transferred from the press belt 5 to the transfer fabric 9. It can be secured by guiding the pulp web 1 on the transfer fabric 9 over a vacuum box 14, where the vacuum at the vacuum box 14 holds the pulp web 1 on the transfer fabric 9 by suction.

Figure 2:
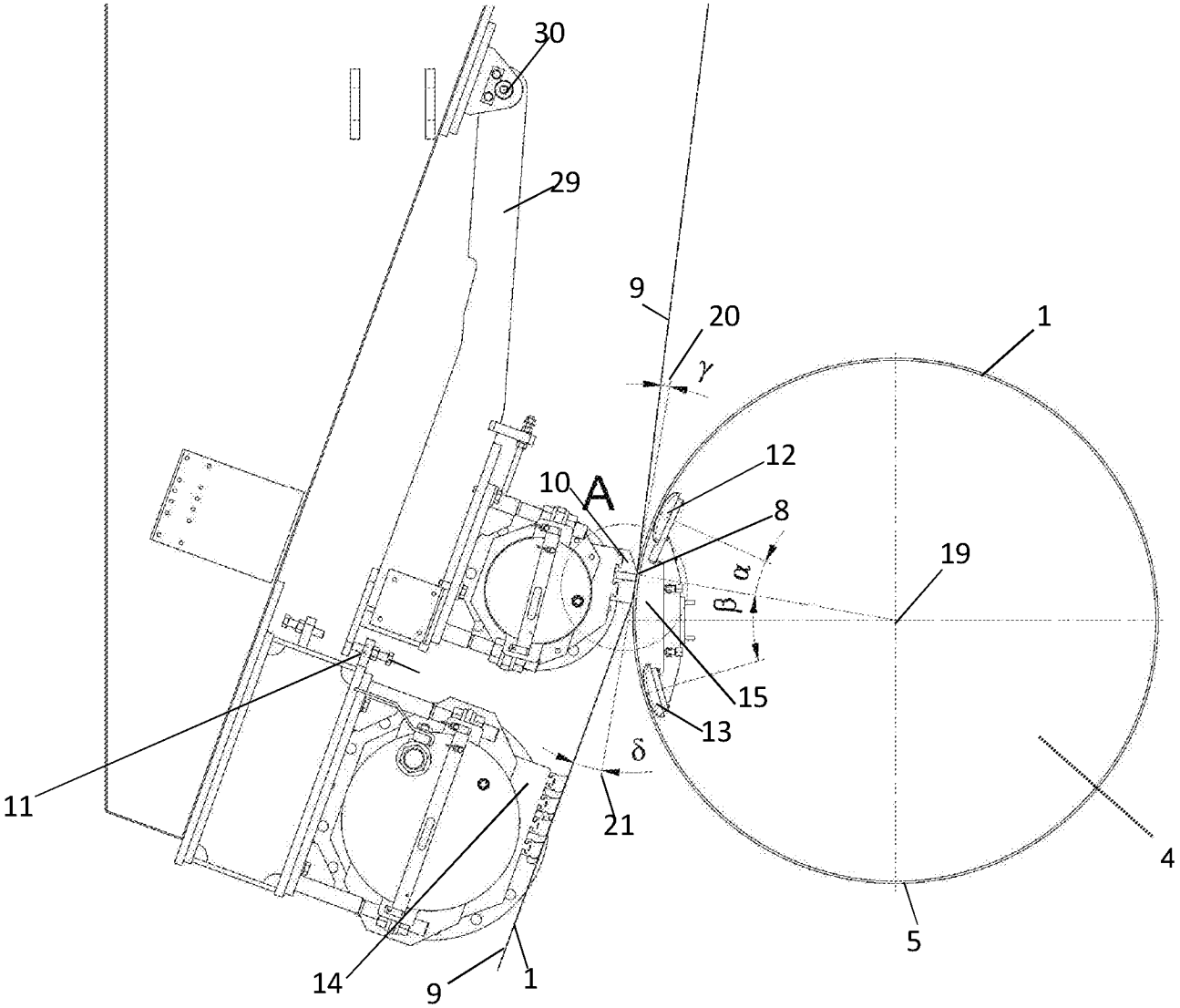
FIG. 2 shows a detailed view of the disclosed transfer arrangement.

FIG. 2 shows a detailed view of the area where the pulp web 1 is transferred to the transfer fabric 9. The pulp web 1 on the press belt 5 is transferred to the transfer fabric 9 in the transfer area 8. This transfer is assisted by the transfer device 10, to which suction is applied. As can be seen, the press belt 5 is not supported in the transfer area 8. That means that no supporting elements are provided in the transfer area 8 on the side 15 of the press belt 5 opposite the pulp web 1. With the press roll 4, a first supporting element 12 for the press belt 5 is provided before the transfer area 8. The angle $\alpha$ between the supporting element 12 in front of the transfer area 8 and the transfer area 8, viewed from the press roll axis (center of the press roll) 19, is less than 15° here, for example 6°.

With press roll 4, a second supporting element 13 on which the press belt 5 is supported is provided after the transfer area 8. The angle $\beta$ between the supporting element 13 and the transfer area 8 is less than 30° here.

The transfer fabric 9 is not wrapped round the press belt 5 beforehand or afterwards in the transfer area 8. In this sense, the angle $\gamma$ between the transfer fabric 9 carried into the transfer area 8 over the stationary transfer device 10 and the tangent 20 to the press belt 5 in the transfer area 8 is greater than zero degrees, meaning that there is no contact between the transfer fabric 9, pulp web 1 and press belt 5 until the transfer area 8. Similarly, the angle $\delta$ between the transfer fabric 9 carried out of the transfer area 8 and the tangent 21 to the press belt 5 is greater than zero degrees in the transfer area 8, with the result that the transfer fabric 9 is not wrapped round the press belt 5 after the transfer area 8 and there is only contact between the transfer fabric 8, pulp web 1 and press belt 5 in the transfer area 8.

The radial depth of insertion by the stationary transfer device 10 into the press belt 5 of the press roll 4 is set by the setting device 11 outside the press roll 4. For example, the stationary transfer device 10 can be secured to a pivoting lever arm 29 on the frame, where it is possible to insert it radially into the press belt 5 in accordance with the center of rotation 30 of the lever arm—taking the center point 19 of the press roll 4 as reference. The setting device 11 has an adjusting screw 28 that is used to set the depth of insertion of the transfer device 10.

Figure 3:
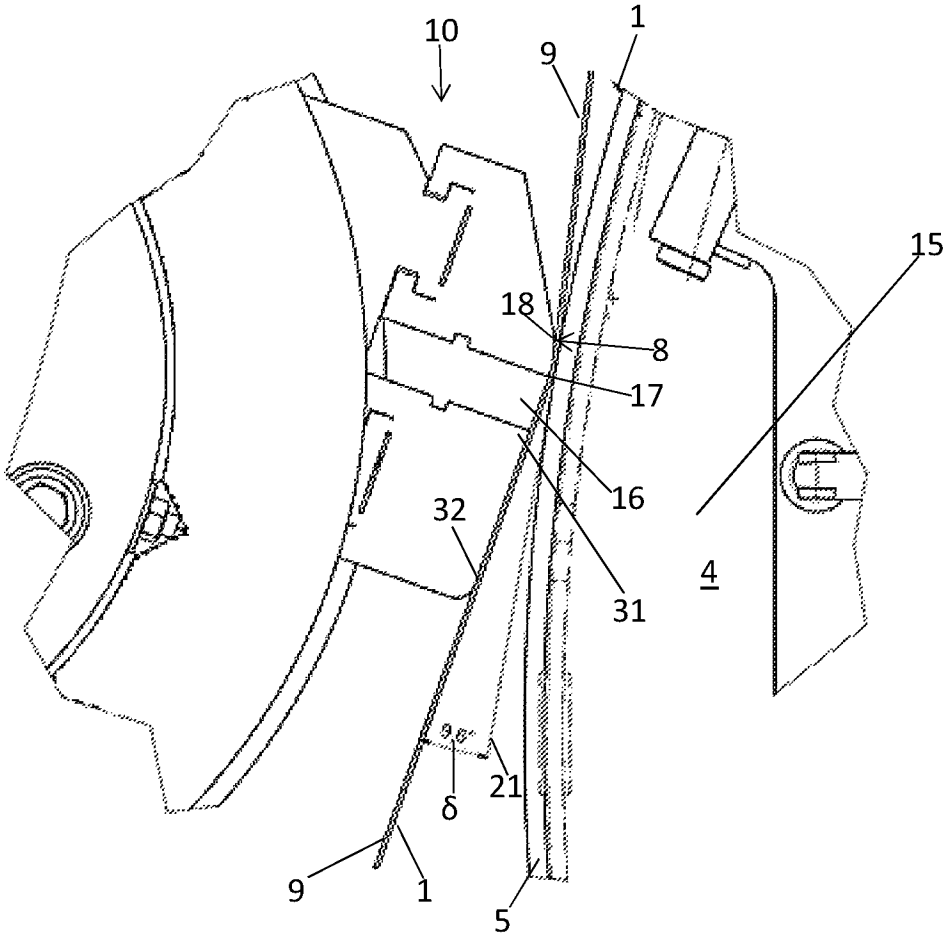
FIG. 3 shows a detailed view of the transfer area.

FIG. 3 shows the transfer area 8 from FIG. 2 in detail. As can be seen, the transfer device 10 is designed as a slotted suction device. Suction is applied through the suction slot 16 to the transfer fabric 9 between a first 17 and second suction slot edge 31. The slotted suction device 10 has a curved area 18 in front of the first suction slot edge 17 on the inlet side. The effective length of the curved area 18 up to the first suction slot edge 17 is less than 30 mm, for example, preferably less than 15 mm. Contact between the stationary transfer device 10 and the transfer fabric 9, the pulp web 1 and the press belt 5 takes place in the curved area 18 in front of the first suction slot edge 17 on the inlet side, where the transfer area 8 is also in the curved section 18 in front of the first suction slot edge 17 on the inlet side. In the present example, the suction slot 16 of the transfer device 10 is already outside the transfer area 8, which means that the transfer fabric 9 no longer touches the press belt 5 in the area of the suction slot 16. After this, the transfer fabric 9 runs over the outlet area 32 of the transfer device 10.

Figure 4:
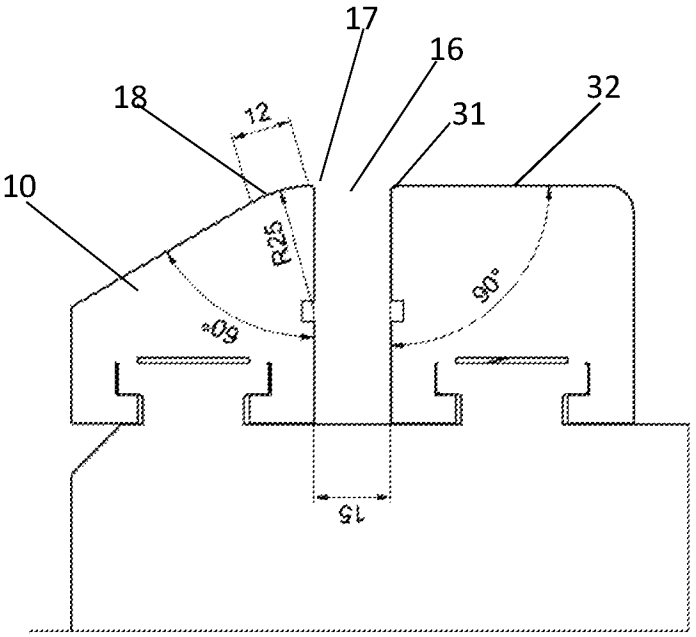
FIG. 4 shows a detailed view of a stationary transfer device over which the transfer fabric is carried.

The transfer device is shown in FIG. 4. The suction slot 16 is 15 mm wide here. The transfer fabric 9 preferably runs onto the transfer device 10 in the curved area 18 in front of the first suction slot edge 17. The curved area 18 is 12 mm long here.

Figure 5:
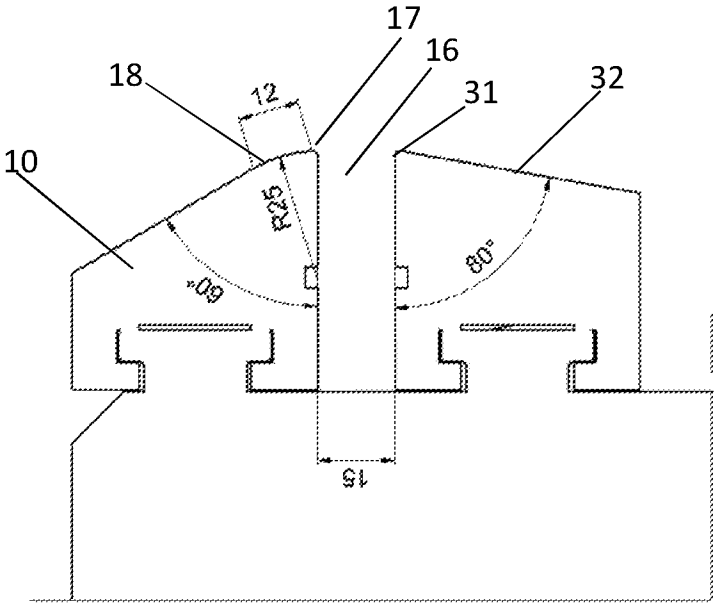
FIG. 5 shows another embodiment of the disclosed stationary transfer device.

FIG. 5 shows another possible embodiment of the transfer device 10. Unlike FIG. 4, the outlet area 32 of the transfer device has a downward sloping design.

Figure 6:
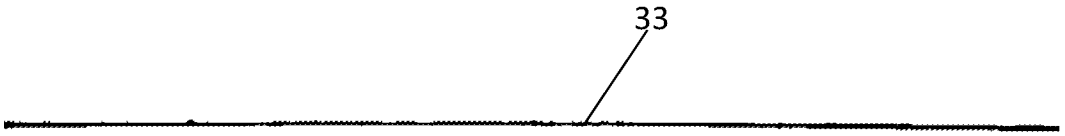
FIG. 6 shows a view of a Fujifilm impression (Ultra Extreme Low Pressure 5 L W) of the transfer area of a transfer arrangement with a 900 mm wide transfer fabric.

FIG. 6 shows a Fujifilm impression 33 (Ultra Extreme Low Pressure 5 L W) of the transfer area 8 of a transfer arrangement designed according to the disclosure; For this purpose, the pressure-sensitive Fujifilm is inserted into the gap between the press belt 5 under pneumatic pressure and the transfer fabric 9 with the transfer device 10 upright and swung down. Then the stationary transfer device 10 with transfer fabric 9 is brought into the operating position against the press belt 5 under pneumatic pressure. Depending on the contact between the components—stationary transfer device 10, transfer fabric 9, Fujifilm and press belt 5—the pressure-sensitive film changes color. A change of color indicates contact and the changed color indicates the transfer area. The Fujifilm impression 33 shows a transfer area 8 with a length of less than 5 mm in the running direction of the pulp web 1, within which the pulp web 1 is transferred from the press belt 5 of the press roll 4 to the transfer fabric 9. The length of contact between the transfer fabric 9 and the press belt 5 perpendicular to the running direction (at right angles to the machine running direction) of the pulp web 1 is 900 mm in this case, corresponding to the width of the transfer fabric of 900 mm in this case.

Figure 7:
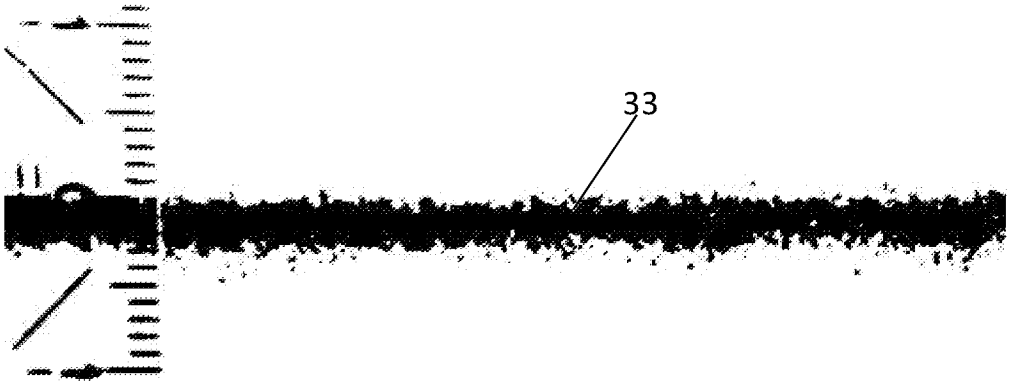
FIG. 7 shows a Fujifilm impression (Ultra Extreme Low Pressure 5 L W) of the transfer area of a transfer arrangement.

FIG. 7 shows a detailed section of the Fujifilm impression 33 (Ultra Extreme Low Pressure 5 L W) from the full impression illustrated in FIG. 6. A scale is provided so that it can be quantified more easily. The scale reads in running direction of the pulp web 1 in units of one centimetre. As the changed colour indicates the transfer area 8, it can be seen easily that there is a transfer area 8 with a length of less than 5 mm in running direction of the pulp web 1 in the section of the Fujifilm impression 33 shown.

REFERENCE NUMERALS

1 Pulp web
2 Paper or tissue machine

3 Extended-nip press unit
4 Press roll
5 Press belt
6 Backing roll
7 Extended press nip
8 Transfer area
9 Transfer fabric
10 Transfer device
11 Setting device
12 First supporting element
13 Second supporting element
14 Suction device
15 Opposite side
16 Suction slot
17 First suction slot edge
18 Curved area
19 Press roll center
20 Tangent 1
21 Tangent 2
22 Headbox
23 Forming roll
24 Breast roll
25 Outer clothing
26 Felt
27 Yankee
28 Adjusting screw
29 Lever arm
30 Fulcrum point of lever arm
31 Second suction slot edge
32 Outlet area
33 Fujifilm impression
Angle α, β, γ, δ

The invention claimed is:

1. A method for treating a pulp web (1) in a paper or tissue machine (2) in an extended-nip press unit (3) with a press roll (4) having a rotating press belt (5), and a backing roll (6), the press roll (4) being a shoe press roll, comprising the steps of:

dewatering the pulp web (1) in an extended press nip (7) between the press belt (5) of the press roll (4) and the backing roll (6) to yield a dewatered pulp web, transferring the dewatered pulp web (1) directly to the rotating press belt (5) of the press roll (4) after the extended press nip (7), passing the dewatered pulp web (1) from the press belt (5) to a transfer fabric (9) in a transfer area (8), wherein the transfer fabric (9) is guided over a stationary transfer device (10) in the transfer area (8).

2. The method according to claim 1, comprising a step of applying suction to the transfer device (10) in the transfer area (8) to support transfer of the pulp web (1) to the transfer fabric (9).

3. The method according to claim 1, characterized in that the transfer device (10) and the transfer fabric (9) running over the press belt (5) of the press roll (4) is inserted radially into the press belt (5) of the press roll (4) a radial insertion between (i) a position touching the press belt with no gap between the transfer fabric (9) and the press belt (5) to define a first position, and (ii) a position inward from the first position by 20 mm to define a radial insertion of 20 mm.

4. The method according to claim 3, characterized in that depth of the radial insertion of the transfer device (10) into the press belt (5) of the press roll (4) in the transfer area (8) is set via a setting device (11) outside the press roll (4).

5. The method according to claim 1, characterized in that the pulp web (1) is transferred from the press belt (5) to a permeable structured transfer fabric (9) in the transfer area (8).

6. The method according to claim 2, characterized in that the pulp web (1) is transferred from the press belt (5) to a permeable transfer fabric (9) in the transfer area (8).

7. The method according to claim 1, characterized in that the pulp web (1) moves in a running direction and is transferred to the transfer fabric (9) in the transfer area (8) over a thickness of less than 10 mm measured in the running direction.

8. The method according to claim 1, characterized in that the transfer fabric (9) moves at a lower speed than the press belt (5) when the pulp web (1) is transferred from the press belt (5) to the transfer fabric (9).

9. The method according to claim 1, wherein supporting elements (12, 13) are positioned on a side (15) of the press roll (4) opposite the pulp web (1) before and after the transfer area (8), the supporting elements (12, 13) being configured to support the press belt (5) of the press roll (4).

10. The method according to claim 9, characterized in that the supporting elements (12, 13) press radially outwards from the press belt (5) of the press roll (4) and the transfer fabric (9) running over the press belt (5) of the press roll (4) is inserted radially into the press belt (5) of the press roll (4) a radial insertion between (i) a position touching the press belt with no gap between the transfer fabric (9) and the press belt (5) to define a first position, and (ii) a position inward from the first position by 20 mm to define a radial insertion of 20 mm.

11. The method according to claim 1, characterized in that the pulp web (1) is guided onto the transfer fabric (9) via a suction device (14) to secure the pulp web (1) onto the transfer fabric (9) after transfer from the press belt (5) of the press roll (4).

12. A press arrangement for treating a pulp web (1) in a paper or tissue machine (2), comprising:

an extended-nip press unit (3) comprising an extended press nip (7) through which the pulp web (1) is guided, the extended-nip press unit (3) further including a press roll (4) with revolving press belt (5) and a backing roll (6), the press roll (4) being a shoe press roll, wherein after the extended press nip (7) of the extended-nip press unit (3), the pulp web (1) is guided directly on the rotating press belt (5) of the press roll (4) to a transfer fabric (9) which receives the pulp web (1) in a transfer area (8), and the transfer fabric (9) is guided over a stationary transfer device (10) in the transfer area (8).

13. The press arrangement according to claim 12, wherein the press belt (5) of the press roll (4) is not supported in the transfer area (8) on a side opposite the pulp web (1).

14. The press arrangement according to claim 13, comprising supporting elements (12, 13) that are lubricated hydrostatically or hydrodynamically or both hydrostatically and hydrodynamically positioned inside the press belt (5) before and after the transfer area (8).

15. The press arrangement according to claim 12, characterized in that the stationary transfer device (10) in the transfer area (8) is a slotted suction device (10).

16. The press arrangement according to claim 15, wherein the slotted suction device (10) has a curved area (18) in front of an inlet side suction slot edge (17).

17. The press arrangement according to claim 12, wherein the transfer fabric (9) runs onto the transfer device (10) before transfer of the pulp web (1) from the press belt (5) of the press roll (4).

18. The press arrangement according to claim 14, characterized in that a circumferential angle ($\alpha$) between the supporting element (12) in front of the transfer area (8) and the transfer area (8) is less than 15° as viewed from a center axis of the press roll (19), and a circumferential angle ($\beta$) between the transfer area (8) and the supporting element (13) after the transfer area (8) is less than 30° as viewed from the center axis of the press roll (19).

19. The press arrangement according to claim 12, characterized in that an angle ($\gamma$) between the transfer fabric (9) guided into the transfer area (8) and a tangent (20) to the press belt (5) is greater than zero degrees in the transfer area (8), thereby preventing or reducing likelihood of the transfer fabric (9) from wrapping round the press belt (5) in front of the transfer area (8).

20. The press arrangement according to claim 12, characterized in that an angle ($\delta$) between the transfer fabric (9) carried out from the transfer area (8) and a tangent (21) to the press belt (5) in the transfer area (8) is greater than zero degrees, thereby preventing or reducing likelihood of the transfer fabric (9) from wrapping around the press belt (5) after the transfer area (8).

* * * * *